US011028703B2

(12) United States Patent
Place

(10) Patent No.: US 11,028,703 B2
(45) Date of Patent: Jun. 8, 2021

(54) GAS TURBINE ENGINE AIRFOIL WITH TIP LEADING EDGE SHELF DISCOURAGER

(71) Applicant: United Technologies Corporation, Farmington, CT (US)

(72) Inventor: Emma J. Place, New Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 328 days.

(21) Appl. No.: 16/002,688

(22) Filed: Jun. 7, 2018

(65) Prior Publication Data

US 2019/0376395 A1 Dec. 12, 2019

(51) Int. Cl.

| | |
|---|---|
| ***F01D 5/20*** | (2006.01) |
| ***F01D 5/18*** | (2006.01) |
| ***F01D 11/08*** | (2006.01) |

(52) U.S. Cl.

CPC ..... *F01D 5/20* (2013.01); *F01D 5/186* (2013.01); *F01D 11/08* (2013.01); *F05D 2240/307* (2013.01); *F05D 2250/182* (2013.01); *F05D 2260/202* (2013.01)

(58) Field of Classification Search

CPC . F01D 5/20; F01D 5/147; F01D 5/186; F01D 5/187; F05D 2240/307

See application file for complete search history.

(56) References Cited

U.S. PATENT DOCUMENTS

| | | | | |
|---|---|---|---|---|
| 4,390,320 | A | 6/1983 | Eiswerth | |
| 5,733,102 | A | 3/1998 | Lee et al. | |
| 6,179,556 | B1 * | 1/2001 | Bunker | F01D 5/187 415/115 |
| 6,224,336 | B1 | 5/2001 | Kercher | |
| 6,837,687 | B2 | 1/2005 | Lee et al. | |
| 9,045,988 | B2 | 6/2015 | Mishra et al. | |
| 9,255,481 | B2 * | 2/2016 | Lim | F01D 5/20 |
| 9,284,845 | B2 | 3/2016 | Lewis et al. | |
| 10,436,040 | B2 | 10/2019 | Rhodes et al. | |
| 2007/0237627 | A1 * | 10/2007 | Bunker | F01D 5/145 415/170.1 |
| 2014/0165593 | A1 | 6/2014 | Quach et al. | |
| 2017/0328229 | A1 | 11/2017 | Olive et al. | |

FOREIGN PATENT DOCUMENTS

| | | | |
|---|---|---|---|
| DE | 19963375 | A1 | 7/2001 |
| EP | 1059419 | A1 | 12/2000 |
| EP | 3348789 | A1 | 7/2018 |
| WO | 2014092922 | A1 | 6/2014 |
| WO | 2017/119898 | A1 | 7/2017 |

OTHER PUBLICATIONS

European Search Report dated Oct. 15, 2019 issued for corresponding European Patent Application No. 19178674.8.

* cited by examiner

*Primary Examiner* — Courtney D Heinle
*Assistant Examiner* — Michael K. Reitz
(74) *Attorney, Agent, or Firm* — Bachman & LaPointe, P.C.

(57) ABSTRACT

An airfoil including a pressure sidewall and a suction sidewall extending from a root section of the airfoil to a tip region of the airfoil and a leading edge and a trailing edge defines a chord length of the airfoil therebetween. A tip shelf is formed along the tip region of the airfoil between the pressure sidewall and a tip shelf wall with a tip shelf discourager that extends from the tip shelf.

13 Claims, 7 Drawing Sheets

GAS TURBINE ENGINE AIRFOIL WITH TIP LEADING EDGE SHELF DISCOURAGER

BACKGROUND

The present disclosure relates to components for a gas turbine engine and, more particularly, to a tip shelf discourager of an airfoil.

Gas turbine engines typically include a compressor section to pressurize airflow, a combustor section to burn a hydrocarbon fuel in the presence of the pressurized air, and a turbine section to extract energy from the resultant combustion gases. Aviation applications include turbojet, turbofan, turboprop and turboshaft engines. Engine performance depends on precise control of the working fluid flow, including flow across the airfoil tip. Where clearance, abrasion and temperature effects are of concern, moreover, these factors often pose competing design demands on compressor and turbine rotor geometry, particularly in the tip region of the airfoil.

The tip region of some airfoils includes tip shelves to improve turbine airfoil durability by allowing cooling holes to be drilled or cast into the shelf which creates a cooling film over the shelf to effectively cool the blade tip region. CFD analysis of current configuration demonstrates that high pressure gas path flow pushes tip shelf cooling air over the airfoil tip prior to creating a film of cooling air on the tip shelf surface. Consequently, part durability is impacted due to cooling air not having time to cover the tip shelf surface.

SUMMARY

An airfoil for a gas turbine engine according to one disclosed non-limiting embodiment of the present disclosure includes a pressure sidewall and a suction sidewall extending to a tip region of the airfoil; a leading edge and a trailing edge defining a chord length of the airfoil therebetween; a tip shelf formed along the tip region of the airfoil between the pressure sidewall and a tip shelf wall; and a tip shelf discourager that extends from the tip shelf.

A further aspect of the present disclosure includes that the tip shelf discourager extends for a portion of a length of the tip shelf.

A further aspect of the present disclosure includes that the tip shelf discourager extends for an entire length of the tip shelf.

A further aspect of the present disclosure includes a squealer pocket formed within the tip region.

A further aspect of the present disclosure includes that the tip shelf wall is between the tip shelf discourager and the squealer pocket.

A further aspect of the present disclosure includes that the tip shelf discourager extends for a height equivalent to the tip shelf wall.

A further aspect of the present disclosure includes that the tip shelf discourager extends for a height less than the tip shelf wall.

A further aspect of the present disclosure includes that the squealer pocket is formed along a portion of the chord of the tip region.

A further aspect of the present disclosure includes that the squealer pocket extends from within 10% of the chord length measured from the leading edge to terminate less than 85% of the chord length measured from the trailing edge.

A further aspect of the present disclosure includes that the squealer pocket extends for more than 15% of the chord length and less than 75% of the chord length.

A further aspect of the present disclosure includes a plurality of cooling holes formed in the squealer pocket to maintain a pocket of cooling fluid along the tip region of the airfoil between the tip shelf wall and the squealer tip wall.

A further aspect of the present disclosure includes that the tip shelf discourager is about 0.01 inches in width.

A further aspect of the present disclosure includes that the tip shelf extends from the leading edge to an intersection of the pressure sidewall and the suction sidewall at the trailing edge such that the tip shelf communicates with both the pressure sidewall and the suction sidewall proximate to the trailing edge, wherein the tip shelf extends around the leading edge and onto the suction sidewall to terminate on the suction sidewall between the leading edge and the trailing edge of the airfoil.

A method of directing a cooling flow from an airfoil for a gas turbine engine, according to one disclosed non-limiting embodiment of the present disclosure includes discouraging a tip shelf cooling air from being mixed with core gas path air and pushed over a blade tip region.

A further aspect of the present disclosure includes directing a portion of the tip shelf cooling air along a length of a tip shelf discourager that extends from a tip shelf.

A further aspect of the present disclosure includes directing a portion of the tip shelf cooling air through cooling holes in a tip shelf discourager that extends from a tip shelf.

A further aspect of the present disclosure includes wherein the tip shelf extends from a leading edge to an intersection of a pressure sidewall and a suction sidewall at a trailing edge such that the tip shelf communicates with both the pressure sidewall and the suction sidewall proximate to the trailing edge, wherein the tip shelf extends around the leading edge and onto the suction sidewall to terminate on the suction sidewall between the leading edge and the trailing edge of the airfoil.

An airfoil for a gas turbine engine according to one disclosed non-limiting embodiment of the present disclosure includes a pressure sidewall and a suction sidewall extending to a tip region of the airfoil; a leading edge and a trailing edge defining a chord length of the airfoil therebetween; a tip shelf formed along the tip region of the airfoil between the pressure sidewall and a tip shelf wall; a tip shelf discourager that extends from the tip shelf, wherein the tip shelf extends from the leading edge to an intersection of the pressure sidewall and the suction sidewall at the trailing edge such that the tip shelf communicates with both the pressure sidewall and the suction sidewall proximate to the trailing edge, wherein the tip shelf extends around the leading edge and onto the suction sidewall to terminate on the suction sidewall between the leading edge and the trailing edge of the airfoil.

A further aspect of the present disclosure includes a squealer pocket formed within the tip region, the squealer pocket extends from within 10% of the chord length measured from the leading edge to terminate less than 85% of the chord length measured from the trailing edge.

A further aspect of the present disclosure includes that the squealer pocket extends for more than 15% of the chord length and less than 75% of the chord length.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
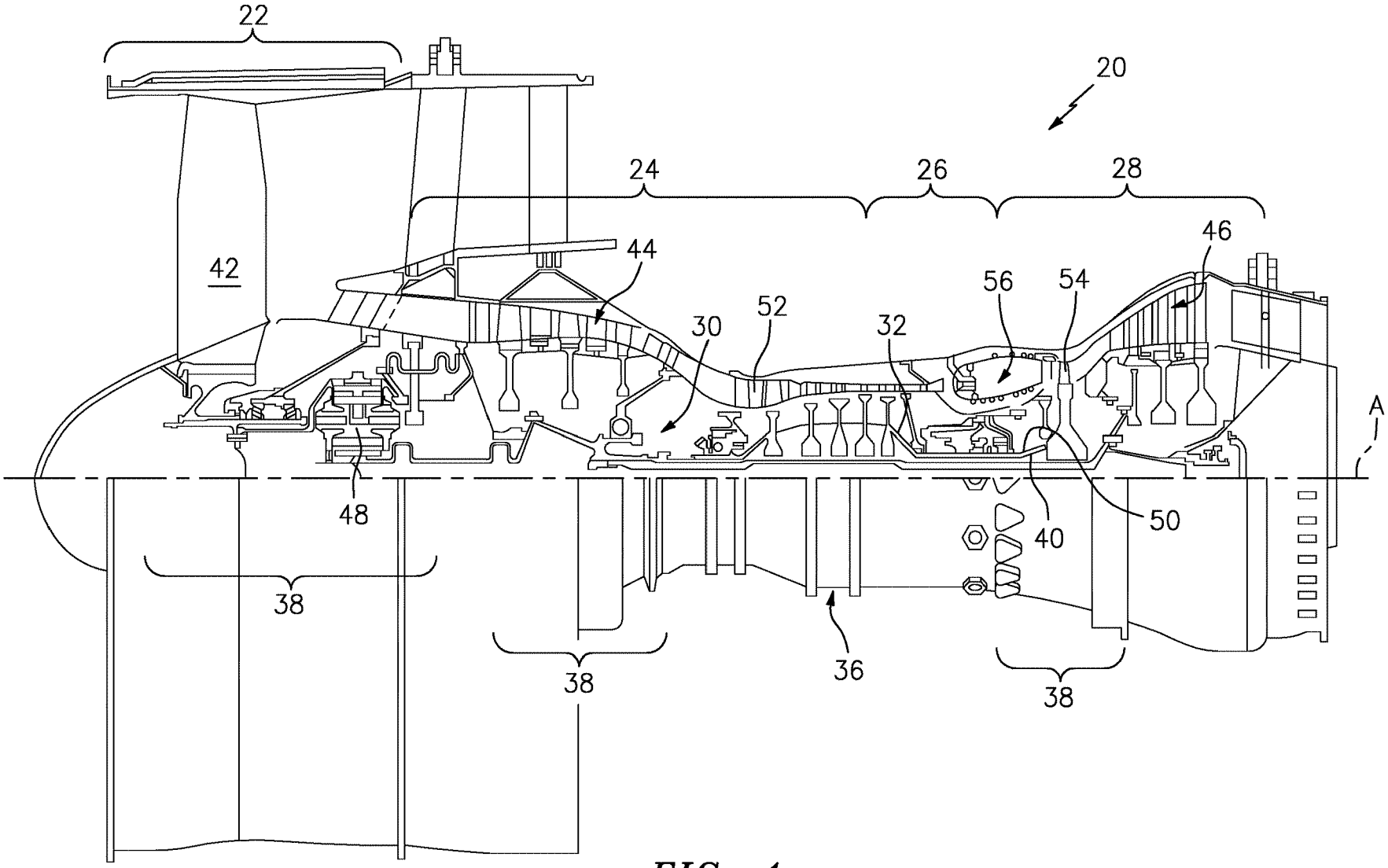
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein may be applied to other types of engine architectures.

The engine 20 generally includes a low spool 30 and a high spool 32 mounted for rotation about an engine central longitudinal axis X relative to an engine static structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis X which is collinear with their longitudinal axes.

Core airflow is compressed by the LPC 44 then the HPC 52, mixed with the fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by bearing structures 38 within the static structure 36.

Figure 2:
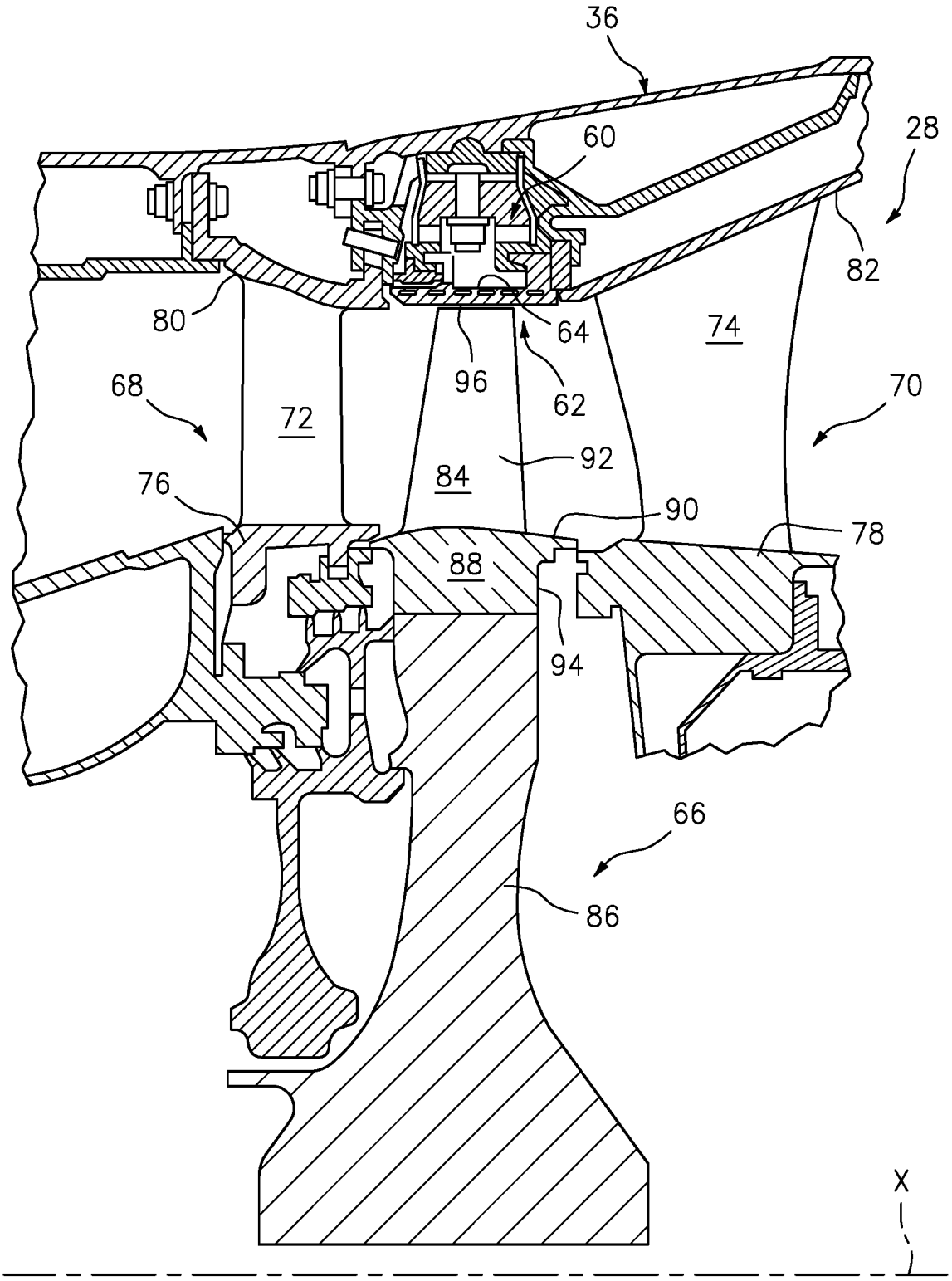
FIG. 2 is an enlarged schematic cross-section of an engine turbine section.

With reference to FIG. 2, an enlarged schematic view of a portion of the turbine section 28 is shown by way of example; however, other engine sections will also benefit herefrom. A full ring shroud assembly 60 within the engine case structure 36 supports a blade outer air seal (BOAS) assembly 62 with a multiple of circumferentially distributed blade outer air seals 64 proximate to a rotor assembly 66 (one schematically shown).

The full ring shroud assembly 60 and the BOAS assembly 62 are axially disposed between a forward stationary vane ring 68 and an aft stationary vane ring 70. Each vane ring 68, 70 includes an array of vanes 72, 74 that extend between a respective inner vane platform 76, 78 and an outer vane platform 80, 82. The outer vane platforms 80, 82 are attached to the engine case structure 36.

Figure 4:
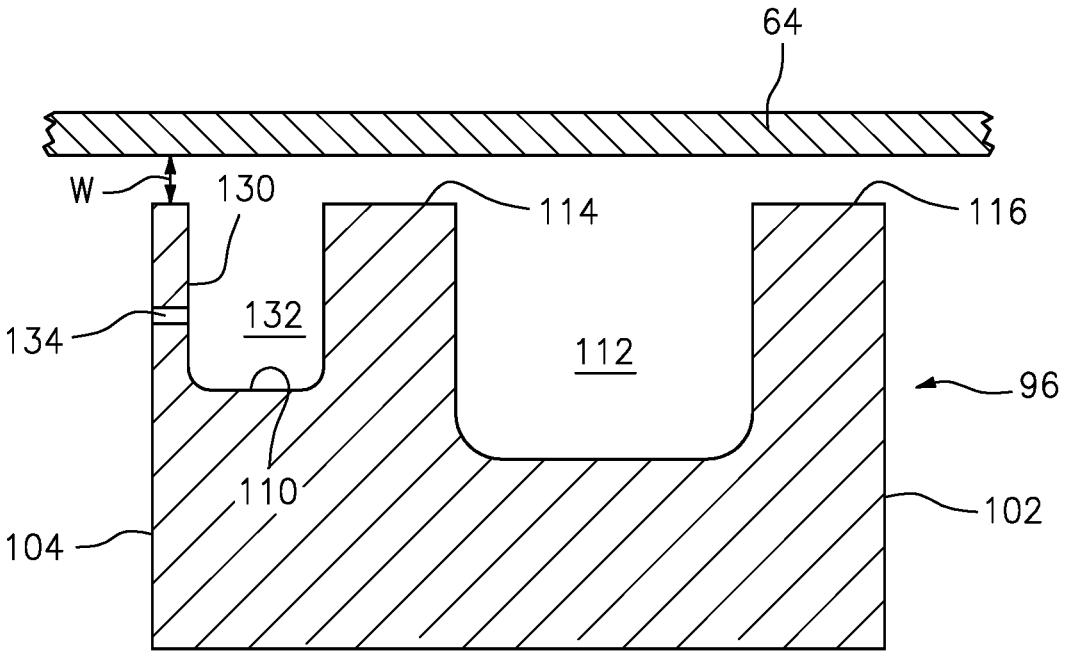
FIG. 4 is a schematic cross-section view of a tip region of FIG. 3 showing the tip shelf discourager according to one disclosed non-limiting embodiment.

The rotor assembly 66 includes an array of blades 84 circumferentially disposed around a disk 86. Each blade 84 includes a root 88, a platform 90 and an airfoil 92 (also shown in FIG. 4). The blade roots 88 are received within a rim 94 of the disk 86 and the airfoils 92 extend radially outward such that a tip region 96 of each airfoil 92 is closest to the blade outer air seal (BOAS) assembly 62. The platform 90 separates a gas path side inclusive of the airfoil 92 and a non-gas path side inclusive of the root 88.

Figure 3:
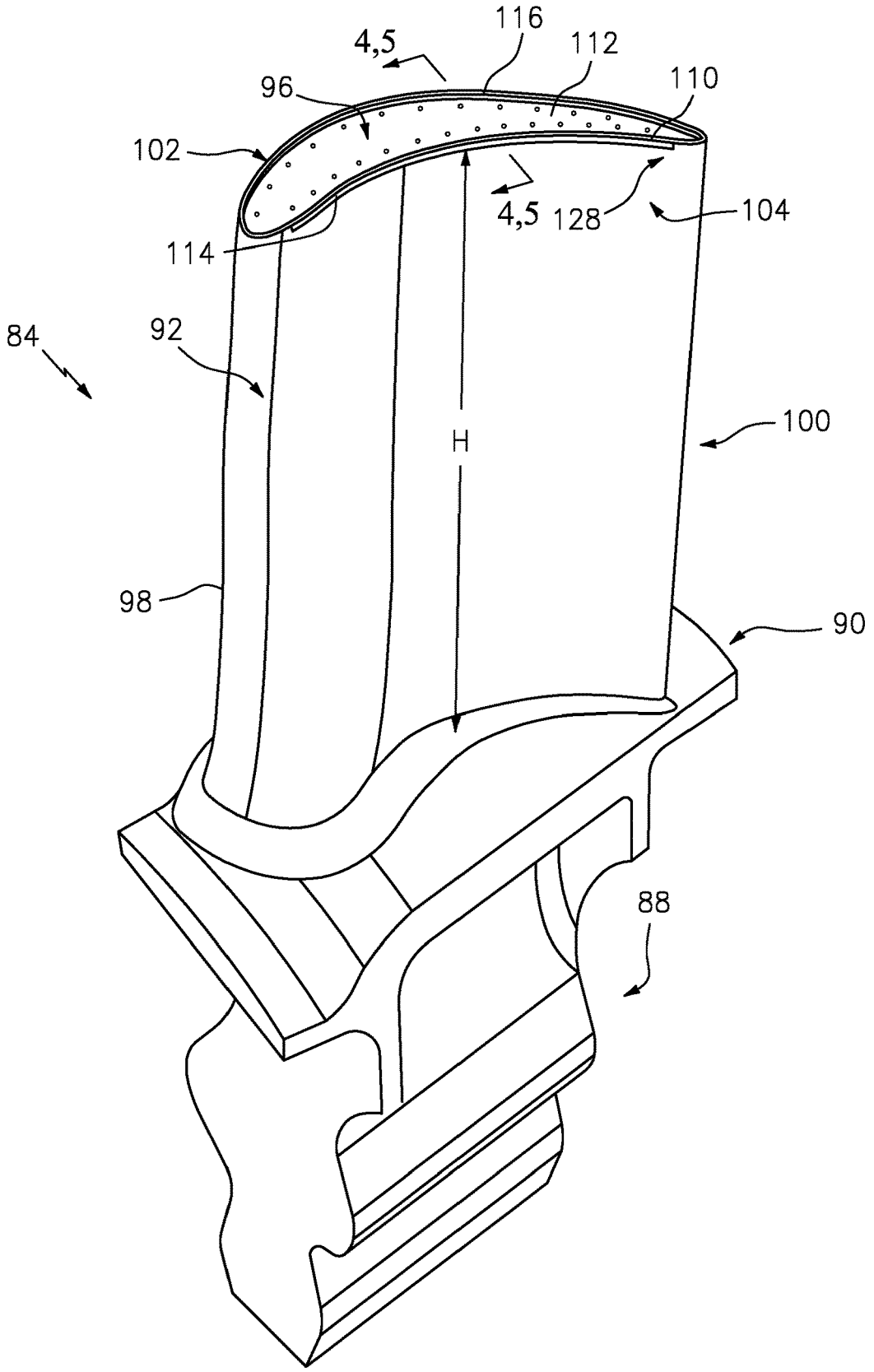
FIG. 3 is a perspective view of an airfoil as an example component with a tip shelf discourager.

With reference to FIG. 3, the platform 90 generally separates the root 88 and the airfoil 92 to define an inner boundary of the core gas path. The airfoil 92 defines a blade chord between a leading edge 98 and a trailing edge 100 and defines a span height H from the platform 90 to the tip region 96. A suction sidewall 102 that may be convex, and a pressure sidewall 104 that may be concave are joined at the leading edge 98 and at the axially spaced trailing edge 100. The tip region 96 extends between the sidewalls 102, 104 opposite the platform 90. It should be appreciated that the tip region 96 may include a recessed portion.

Figure 5:
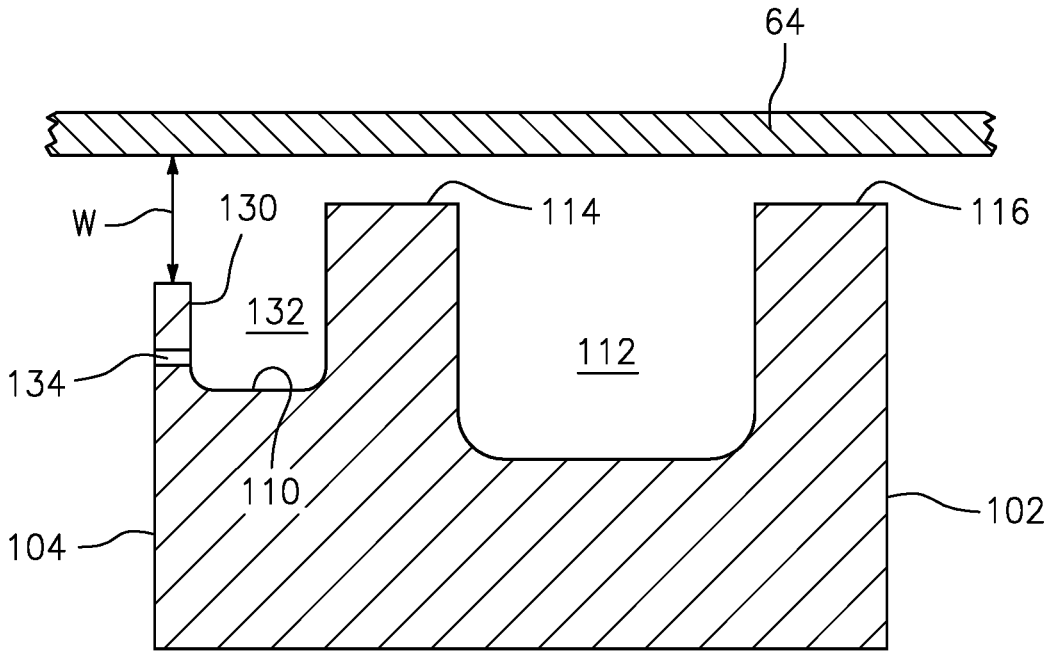
FIG. 5 is a schematic cross-section view of a tip region of FIG. 3 showing the tip shelf discourager according to another disclosed non-limiting embodiment.

A tip shelf 110 and a squealer pocket 112 (also shown in FIG. 4) are formed in the tip region 96 to provide improved tip cooling and resistance to oxidation, erosion and burn-through. The tip shelf 110 is located along the chord of the tip region 96, extending axially from the leading edge 98 to the trailing edge 100 along the pressure sidewall 104. A tip shelf discourager 130 extends from the tip shelf 110. The tip shelf discourager 130 separates the tip shelf 110 from the pressure side gas path flow and essentially extends the span of the pressure sidewall 104 to form a discourager pocket 132 (FIGS. 4 and 5) which is a closed radial recess in the tip region 96 adjacent to the squealer pocket 112. The tip shelf discourager 130 provides an aerodynamic advantage as the tip shelf discourager 130 discourages cooling flow from mixing back into the core airflow.

A pressure side squealer tip wall 114 extends axially along tip region 96, from leading edge 98 to trailing edge 100. The pressure side squealer tip wall 114 is defined between the tip shelf 110 or discourager pocket 132 and the squealer pocket 112, spaced from the pressure sidewall 104 by the discourager pocket 132, and spaced from the suction sidewall 102 by squealer pocket 112.

The squealer pocket 112 defines a closed perimeter radial recess in tip region 96, between the pressure side squealer tip wall 114 and suction side squealer tip wall 116. The suction side squealer tip wall 116 extends axially along the suction sidewall 102 of airfoil 92 at tip region 96, from the leading edge 98 to the trailing edge 100. The squealer pocket 112 retains cooling fluid (e.g., air) along the tip region 96 between the pressure sidewall 104 and the suction sidewall 102. The discourager pocket 132 maintains a region or pocket of cooling fluid along the pressure sidewall 104.

The tip shelf discourager 130 may extend for the entire chord of the airfoil from the leading edge 98 to the trailing edge 100 or for only a portion of the airfoil chord. The radial height of the tip shelf discourager 130 may be equivalent to the overall radial height of the airfoil 92 (FIG. 4) or less (FIG. 5) to define a clearance "W" with respect to the blade outer air seal 64. The clearance "W" be greater than or equal to one quarter the distance between the tip shelf 110 and the pressure side squealer tip wall 114 and minimum of 0.020 inches (0.5 mm) in radial height.

The tip shelf discourager 130 may be parallel to the pressure side squealer tip wall 114 and transverse to the tip shelf 110. In embodiments, the tip shelf discourager 130 may be at least from 0.010 inches (0.254 mm) (0.015 inches (0.381 mm) nominal with a profile tolerance of 0.010 inches (0.254 mm)). The width of the tip shelf 110 may be a minimum of 1.5× the width of the tip shelf discourager 130 to accommodate core printouts into the tip shelf 110.

Figure 6:
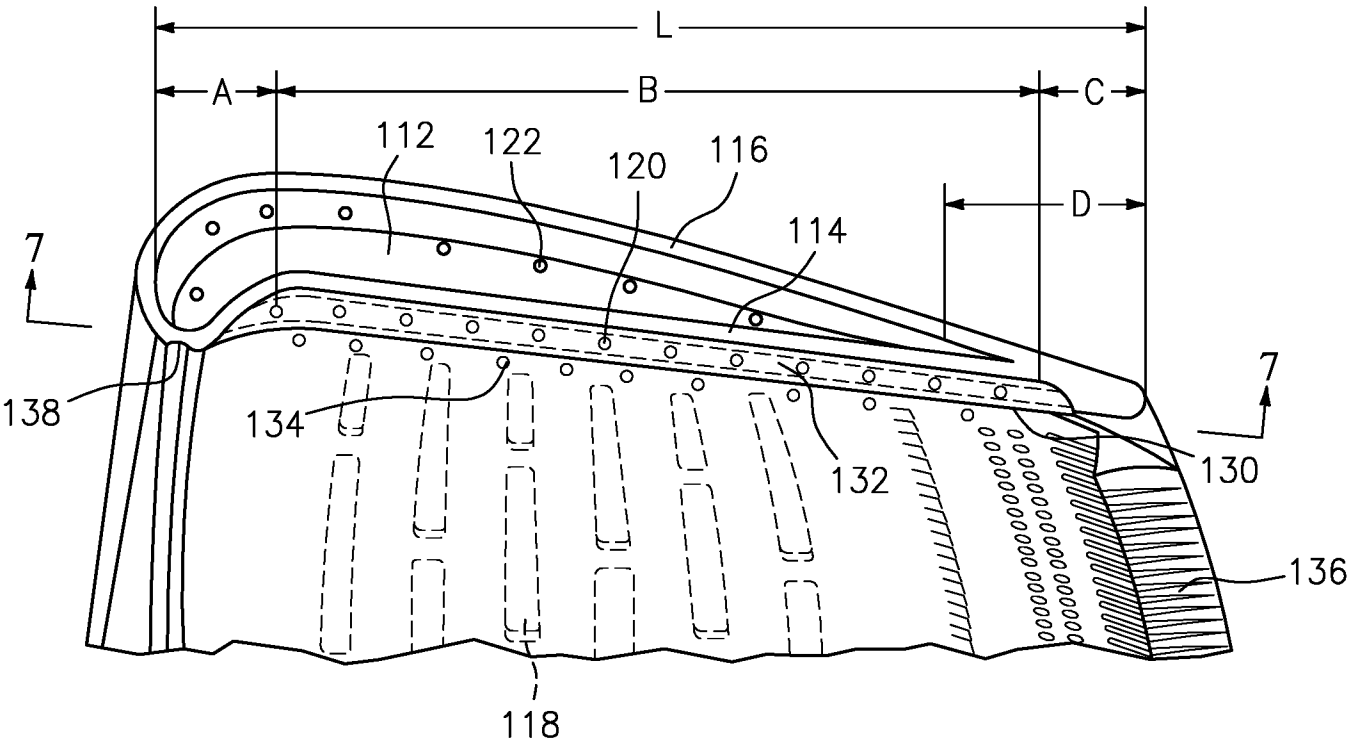
FIG. 6 is a perspective partial phantom view of the tip region.
Figure 7:
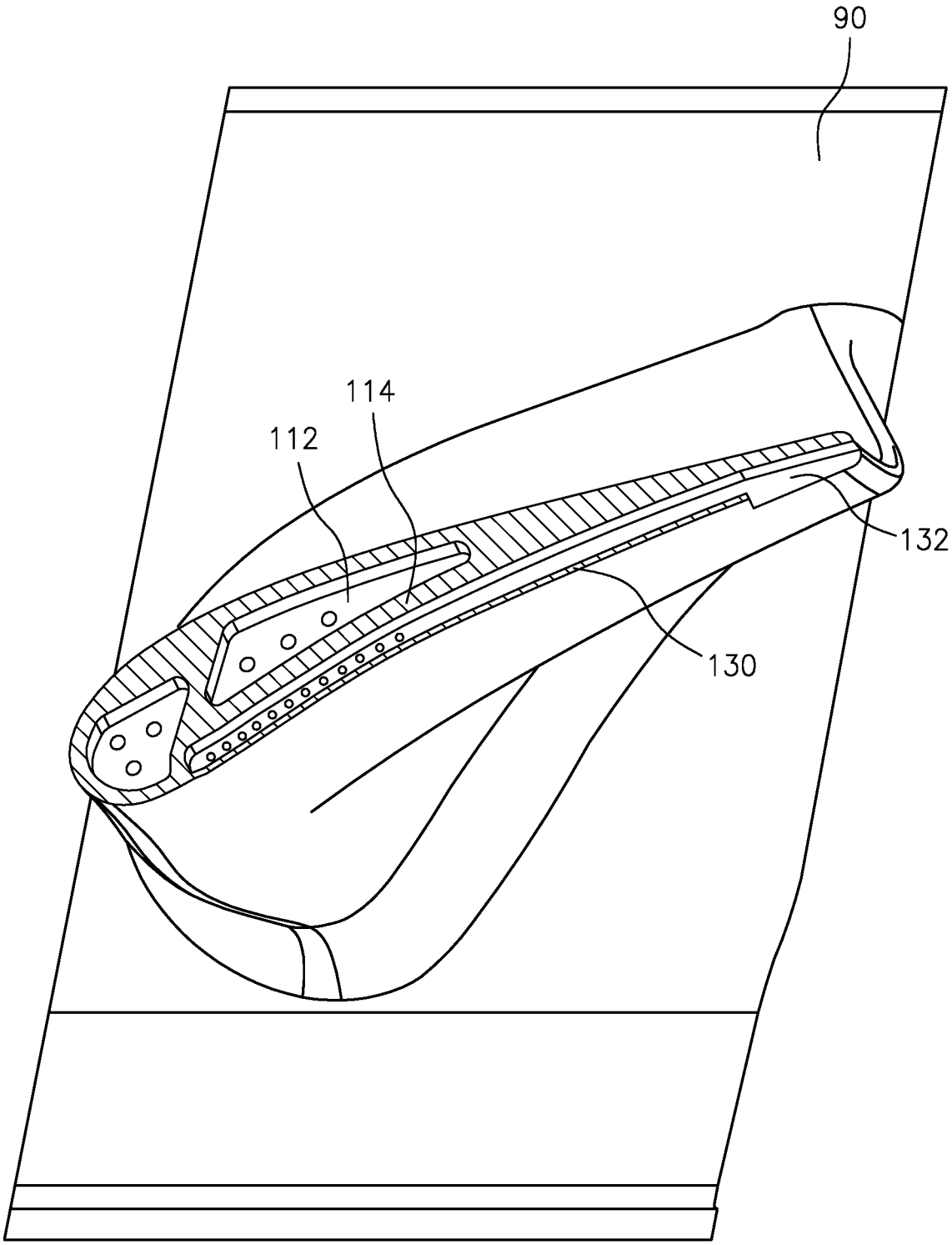
FIG. 7 is a schematic cross-section view of the tip region of FIG. 6 showing the tip shelf discourager wall structure.

With reference to FIG. 6, the suction side squealer tip wall 116 is coextensive with the suction sidewall 102, and spaced from the pressure side squealer tip wall 114 by the squealer pocket 112 in the mid-chord region B. Alternatively, the squealer pocket 112 may be segregated into multiple sections (FIG. 7). The pressure side squealer tip wall 114 and the suction side squealer tip wall 116 may be of the same radial height and meet in the leading edge region A, along leading edge 98, and in trailing edge region C, along trailing edge 100.

In embodiments, the tip shelf 110 and the tip shelf discourager 130 extends along the tip region 96 for substantially all of the chord length L, including within the leading edge region A, (e.g., defined within 5-10% of chord length L from the leading edge 98), a mid-chord region B, (e.g., defined between 5-10% and 90-95% of the chord length L) and a trailing edge region C (e.g., defined within 5-10% of the chord length L from trailing edge 100). The tip shelf 110 and the tip shelf discourager 130 may thus extend more than 90%-95% of the chord length L between the leading edge 98 and the trailing edge 100. In embodiments, the squealer pocket 112 extends from 75%-90% of the chord length L. The squealer pocket 112 may extend from within 5-10% of the chord length L from leading edge 98 in the leading edge region A, through the mid-chord region B to terminate in an aft region D from trailing edge 100 (e.g., defined between 10-25% of the chord length L). Thus, the tip shelf 110 and the tip shelf discourager 130 may be longer than squealer pocket 112 along chord L. This configuration facilitates a decrease in tip leakage over substantially the entire length of airfoil 92 along tip region 96, improving rotor stage efficiency by reducing the tip loss penalty.

The combination of the tip shelf 110 and the squealer pocket 112 reduce the heat transfer coefficient across the tip region 96, which reduces the net heat flux into the airfoil tip region 96 which may extend the performance and service life of the airfoil 92. More specifically, the heat transfer coefficient may be substantially proportional to the Reynold's Number, which in turn may be substantially proportional to the mass flow. The structure of the tip shelf 110 and the squealer pocket 112 reduces mass flow, so the heat transfer coefficient is reduced in the tip region 96. That is, there is less heat transfer from the hot core gas (working fluid) into the airfoil tip region 96 which results in in decreases thermal effects and improved service life for the airfoil 92.

The airfoil 92 may also include internal cooling channels 118. The internal cooling channels 118 provide cooling air into the discourager pocket 132 via tip shelf cooling holes 120, and to the squealer pocket 112 via squealer tip cooling holes 122. The tip shelf cooling holes 120 maintain a region of cooling fluid in the discourager pocket 132, extending between the pressure side squealer tip wall 114 and the pressure sidewall 104. The squealer tip cooling holes 122 maintain a region of cooling fluid in the squealer tip recess 108. The discourager pocket 132 of cooling fluid provides a more uniform cooling temperature along the tip region 96 for better oxidation resistance, reduced erosion, and less burn-through. In embodiments, the tip shelf discourager 130 may include cooling apertures 134 to permit cooling flow from the tip shelf cooling holes 120 to flow through the tip shelf discourager 130.

In some embodiments, the internal cooling channels 118 also provide additional cooling flow, for example, to trailing edge cooling slots 136. In embodiments, the leading edge 98 is configured with indentation 138 to develop heat transfer and flow properties within an otherwise potential leading edge stagnation region.

The tip shelf 110 facilities cooling the tip region 96 as the cooling holes 120 along the tip shelf 110 direct cooling flow upward and over the tip region 96 to cool the tip region 96. The tip shelf discourager 130 operates as a barrier between the tip shelf cooling flow from the tip shelf cooling holes 120 and the core gas path flow to discourage tip shelf cooling air from being mixed with core gas path air and pushed over the blade tip region and instead to be directed along the length of the tip shelf discourager 130. This allows the cooling air to sit on the tip shelf 110 longer and thereby more effectively cool the blade tip region. This facilitates an improvement of the overall durability since the tip region is the thermally limited feature in most 1st stage HPT airfoils. The tip shelf discourager 130 also improves performance since tip clearances between the top of the ledge and the blade outer air seal 64 (FIGS. 4 and 5) are reduced that between the surface of the tip shelf 110 and the blade outer air seal 64. This decrease in tip clearance reduces leakage at and improves performance efficiency.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. An airfoil for a gas turbine engine, comprising:

a pressure sidewall and a suction sidewall extending to a tip region of the airfoil;

a leading edge and a trailing edge defining a chord length of the airfoil therebetween;

a suction side squealer tip wall that extends axially along the suction sidewall of the airfoil at the tip region from the leading edge to the trailing edge;

a pressure side squealer tip wall that extends axially along the tip region, from leading edge to trailing edge;

a squealer pocket formed within the tip region between the pressure sidewall and the suction sidewall, the squealer pocket defines a closed perimeter radial recess in the tip region between the pressure side squealer tip wall and suction side squealer tip wall as the pressure side squealer tip wall is of the same radial height from a bottom of the squealer pocket as the suction side squealer tip wall;

a tip shelf formed along the tip region of the airfoil transverse to the pressure side squealer tip wall; and a tip shelf discourager that extends from the tip shelf, the tip shelf discourager is equal to a radial height of the pressure side squealer tip wall and the suction side squealer tip wall, the tip shelf discourager comprises cooling apertures to permit cooling flow from tip shelf cooling holes to flow through the tip shelf discourager, wherein the tip shelf discourager extends for only a portion of a length of the tip shelf to form a discourager pocket along the pressure sidewall adjacent the trailing edge.

2. The airfoil as recited in claim 1, wherein the squealer pocket extends for more than 15% of the chord length and less than 75% of the chord length.

3. The airfoil as recited in claim 1, further comprising a plurality of cooling holes formed in the squealer pocket to maintain a pocket of cooling fluid along the tip region of the airfoil between the pressure side squealer tip wall and the suction side squealer tip wall.

4. The airfoil as recited in claim 1, wherein the tip shelf discourager is about 0.01 inches in width.

5. The airfoil as recited in claim 1, wherein the squealer pocket is formed along a portion of the chord of the tip region, the squealer pocket extends from within 10% of the chord length measured from the leading edge to terminate less than 85% of the chord length measured from the trailing edge.

6. The airfoil as recited in claim 1, wherein the pressure side squealer tip wall is defined between the tip shelf or discourager pocket and the squealer pocket, spaced from the pressure sidewall by the discourager pocket, and spaced from the suction sidewall by the squealer pocket.

7. The airfoil as recited in claim 1, wherein the width of the tip shelf may be a minimum of 1.5 times the width of the tip shelf discourager.

8. The airfoil as recited in claim 1, wherein the tip shelf and the tip shelf discourager is longer than the squealer pocket along the chord.

9. A method of directing a cooling flow from an airfoil for a gas turbine engine, comprising:

discouraging a tip shelf cooling air from being mixed with core gas path air and pushed over a blade tip region with a tip shelf discourager that is equal to a radial height of a pressure side squealer tip wall and a suction side squealer tip wall that defines a closed perimeter radial recess in the tip region between the pressure side squealer tip wall and suction side squealer tip wall as the pressure side squealer tip wall is of the same radial height from a bottom of the squealer pocket as the suction side squealer tip wall, the tip shelf discourager comprises cooling apertures to permit cooling flow from tip shelf cooling holes to flow through the tip shelf discourager, wherein the tip shelf discourager extends for only a portion of a length of the tip shelf to form a discourager pocket along the pressure sidewall adjacent the trailing edge maintaining a region of cooling fluid along the pressure sidewall; and directing a portion of a tip shelf cooling air through cooling holes in the tip shelf discourager that extends from a tip shelf toward the pressure side of the airfoil.

10. The method as recited in claim 9, further comprising directing a portion of the tip shelf cooling air along a length of a tip shelf discourager that extends from a tip shelf.

11. An airfoil for a gas turbine engine, comprising:

a pressure sidewall and a suction sidewall extending to a tip region of the airfoil;

a leading edge and a trailing edge defining a chord length of the airfoil therebetween;

a tip shelf formed along the tip region of the airfoil between the pressure sidewall and a pressure side squealer tip wall;

a suction side squealer tip wall that extends axially along the suction sidewall of the airfoil at the tip region from the leading edge to the trailing edge;

a pressure side squealer tip wall that extends axially along the tip region, from leading edge to trailing edge;

a squealer pocket formed within the tip region between the pressure sidewall and the suction sidewall, the squealer pocket defines a closed perimeter radial recess in the tip region between the pressure side squealer tip wall and suction side squealer tip wall as the pressure side squealer tip wall is of the same radial height from a bottom of the squealer pocket as the suction side squealer tip wall;

a tip shelf discourager that extends from the tip shelf, wherein the tip shelf extends from the leading edge of a pressure side squealer tip wall to an intersection of the pressure sidewall and the suction sidewall adjacent the trailing edge such that the tip shelf communicates with both the pressure sidewall and the suction sidewall proximate to the trailing edge, the tip shelf discourager is equal to a radial height of the pressure side squealer tip wall and the suction side squealer tip wall, the tip shelf discourager comprises cooling apertures to permit cooling flow from tip shelf cooling holes to flow through the tip shelf discourager, wherein the tip shelf extends from the leading edge to an intersection of the pressure sidewall and the suction sidewall adjacent the trailing edge such that the tip shelf communicates with both the pressure sidewall and the suction sidewall proximate to the trailing edge, wherein the tip shelf extends around the leading edge and onto the suction sidewall to terminate on the suction sidewall between the leading edge and the trailing edge of the airfoil, wherein the tip shelf discourager extends for only a portion of a length of the tip shelf to form a discourager pocket along the pressure sidewall adjacent the trailing edge;

a multiple of tip shelf cooling holes that direct a portion of a tip shelf cooling air between the pressure side squealer tip wall and the tip shelf discourager; and a multiple of cooling holes through the tip shelf discourager that direct a portion of a tip shelf cooling air from the multiple of tip shelf cooling holes through the tip shelf discourager toward the pressure side of the airfoil.

12. The airfoil as recited in claim 11, further comprising a squealer pocket formed within the tip region, the squealer pocket extends from within 10% of the chord length measured from the leading edge to terminate less than 85% of the chord length measured from the trailing edge.

13. The airfoil as recited in claim 12, wherein the squealer pocket extends for more than 15% of the chord length and less than 75% of the chord length.

* * * * *